US006557629B2

(12) United States Patent
Wong et al.

(10) Patent No.: US 6,557,629 B2
(45) Date of Patent: May 6, 2003

(54) WELLHEAD ISOLATION TOOL

(75) Inventors: Henry Wong, Houston, TX (US); Roy W. Benefield, Fredricksburg, TX (US); George E. Guthrie, New Caney, TX (US); Christopher P. Egan, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/967,354

(22) Filed: Sep. 28, 2001

(65) Prior Publication Data

US 2002/0117298 A1 Aug. 29, 2002

Related U.S. Application Data

(60) Provisional application No. 60/236,671, filed on Sep. 29, 2000.

(51) Int. Cl.[7] ..... E21B 43/00

(52) U.S. Cl. ..... 166/76.1; 166/77.51; 166/85.1; 166/88.1

(58) Field of Search ..... 166/77.51, 85.1, 166/76.1, 379, 75.1, 88.1, 381

(56) References Cited

U.S. PATENT DOCUMENTS 3,830,304 A * 8/1974 Cummins
4,111,261 A * 9/1978 Oliver
4,867,243 A * 9/1989 Garner et al.

* cited by examiner

*Primary Examiner*—Roger Schoeppel
(74) *Attorney, Agent, or Firm*—Henry C. Query, Jr.

(57) ABSTRACT

A wellhead isolation tool for use with a wellhead assembly from which a tubing string is suspended comprises a tubular mandrel which includes an axial passage that extends therethrough and lower end that is adapted to engage the tubing string, a pumping head which is connected over the wellhead assembly and which includes an internal chamber that is in fluid communication with the axial passage and a port that extends through the pumping head to the chamber, and an actuator which is connected over the pumping head for moving the mandrel axially through the pumping head and into engagement with the tubing string. When the mandrel is engaged with the tubing string, fluid may be communicated through the port, the chamber and the mandrel and into the tubing string.

17 Claims, 5 Drawing Sheets

WELLHEAD ISOLATION TOOL

This application claims benefit of Provisional application Ser. No. 60/236,671 filed Sep. 29, 2000.

BACKGROUND OF THE INVENTION

The present invention relates to a wellhead isolation tool ("WIT") and, more specifically, to such a tool which locates the fluid control and connection devices at the lower end of the WIT.

A WIT is typically used in an oil or gas well to protect the internal surfaces of the wellhead assembly that is installed at the top of the well bore from corrosive or erosive materials during stimulation of the well. The WIT is normally mounted on the top of the wellhead assembly and comprises a tubular mandrel which is inserted through the wellhead assembly and sealed to the production tubing string. The well stimulation fluid is then pumped through the mandrel and into the production tubing string. Means, such as one or more hydraulic cylinders, are usually provided to raise and lower the mandrel through the wellhead assembly. Because of the large stroke required to do this, the WIT is usually quite tall—at least as tall as the wellhead assembly. In previous WIT designs, the mandrel extends beyond the top of the hydraulic cylinders and the stimulation fluid is injected into the top end of the mandrel. To make the necessary connections, workers have to access the top of the WIT, which requires the construction of platforms, ladders and the like. This not only increases costs, but also creates a safety concern.

SUMMARY OF THE INVENTION

In accordance with the present invention, these and other limitations in the prior art are overcome by providing a wellhead isolation tool for use with a wellhead assembly from which a tubing string is suspended, the wellhead isolation tool comprising a tubular mandrel which includes an axial passage that extends therethrough and a lower end that is adapted to engage the tubing string, a pumping head which is connected over the wellhead assembly and which includes an internal chamber that is in fluid communication with the axial passage and a port that extends through the pumping head to the chamber, and an actuator assembly which is connected over the pumping head and which functions to move the mandrel axially through the pumping head and into engagement with the tubing string. In this manner, when the mandrel is engaged with the tubing string, fluid may be communicated through the port, the chamber and the mandrel and into the tubing string.

In accordance with a preferred embodiment of the invention, the wellhead isolation tool also comprises a sleeve which is connected between the actuator assembly and the mandrel and which is positioned at least partially within the chamber when the mandrel is engaged with the tubing string. The sleeve comprises an axial bore that communicates with the axial passage in the mandrel and at least one generally radial bore that communicates between the chamber and the axial bore.

In addition, the wellhead isolation tool preferably includes a generally cylindrical diffusion element which is positioned within the chamber. The diffusion element includes an outer diameter surface, an inner diameter surface which surrounds at least a portion of the sleeve when the mandrel is engaged with the tubing string, and a plurality of holes which extend generally radially between the inner and outer diameter surfaces.

Thus, the present invention allows the well stimulation fluid to be injected from the side of the pumping head, which is located between the wellhead assembly and the actuator assembly. Consequently, all the control, injection and lock-down functions are located in one convenient area at the lower end of the WIT. Therefore, no need exists to access the top of the WIT, which reduces costs and safety concerns. In addition, the diffusion element disperses the flow of the incoming fluid and thus prevents the fluid from impinging on isolated spots within the sleeve. Therefore, the diffusion element prevents the fluid from unduly eroding the sleeve.

These and other objects and advantages of the present invention will be made apparent from the following detailed description, with reference to the accompanying drawings.

DETAILED DESCRIPTION OF THE PREFERRED EMBODIMENTS

The wellhead isolation tool ("WIT") of the present invention is especially useful in protecting the internal surfaces of a wellhead assembly from erosion or corrosion during stimulation of an oil or gas well over which the wellhead assembly is installed, while at the same time providing convenient access to the fluid injection ports at the lower end of the WIT. For purposes of the present application, the WIT, which is indicated generally in the Figures by reference number 10, is shown in conjunction with an exemplary wellhead assembly. However, it should be understood that the WIT may be used with a variety of wellhead and christmas tree assemblies, either surface or subsea, and that the present invention should not be considered as limited to the wellhead assembly described herein.

Figure 3:
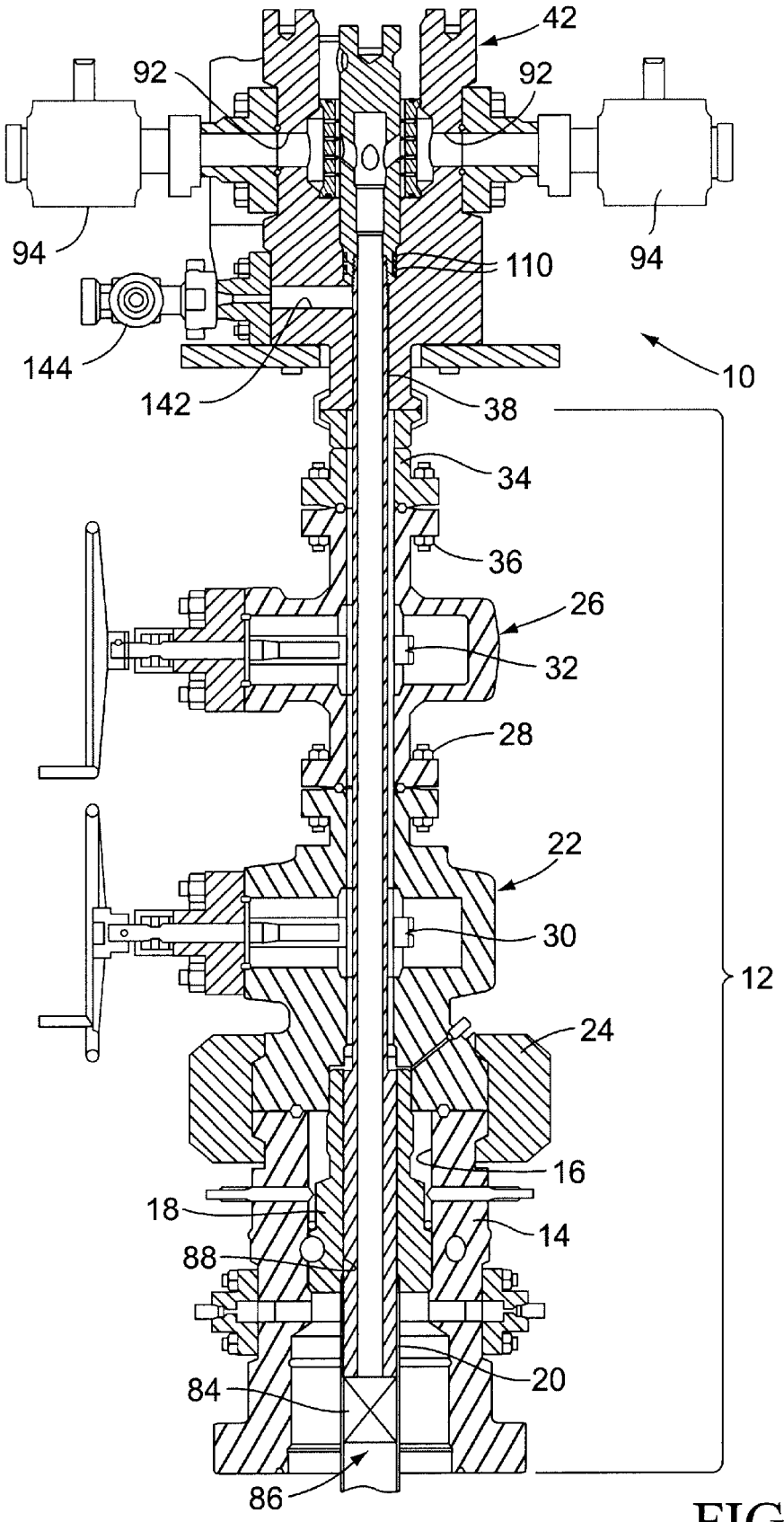
FIG. 3 is a cross-sectional view of the pumping head portion of the WIT shown installed on an exemplary wellhead assembly.

Referring to FIG. 3, the WIT 10 is shown connected to the top of an exemplary wellhead assembly 12 that is installed at the upper end of a well bore (not shown). The wellhead assembly 12 comprises a wellhead or tubing spool 14 having a central bore 16 in which a tubing hanger 18 is supported. The tubing hanger 18 in turn is connected to the upper end of a string of production tubing 20 that extends into the well bore. A first valve assembly 22 is connected to the top of the wellhead 14, for example using a conventional clamp-type connector 24, and a second valve assembly 26 may be connected to the top of the first valve assembly such as by bolts 28. The first and second valve assemblies 22, 26 are provided to control the flow of fluid through the production tubing 20, and in the embodiment of the wellhead assembly 12 shown in FIG. 3, the valve assemblies comprise conventional gate valves having respective gates 30 and 32. In addition, the wellhead assembly 12 may include a connector 34 to facilitate attaching the WIT 10 to the second valve assembly 26. As shown in FIG. 3, the connector 34 may be secured to the top of the second valve assembly 26 by bolts 36.

Figure 1:
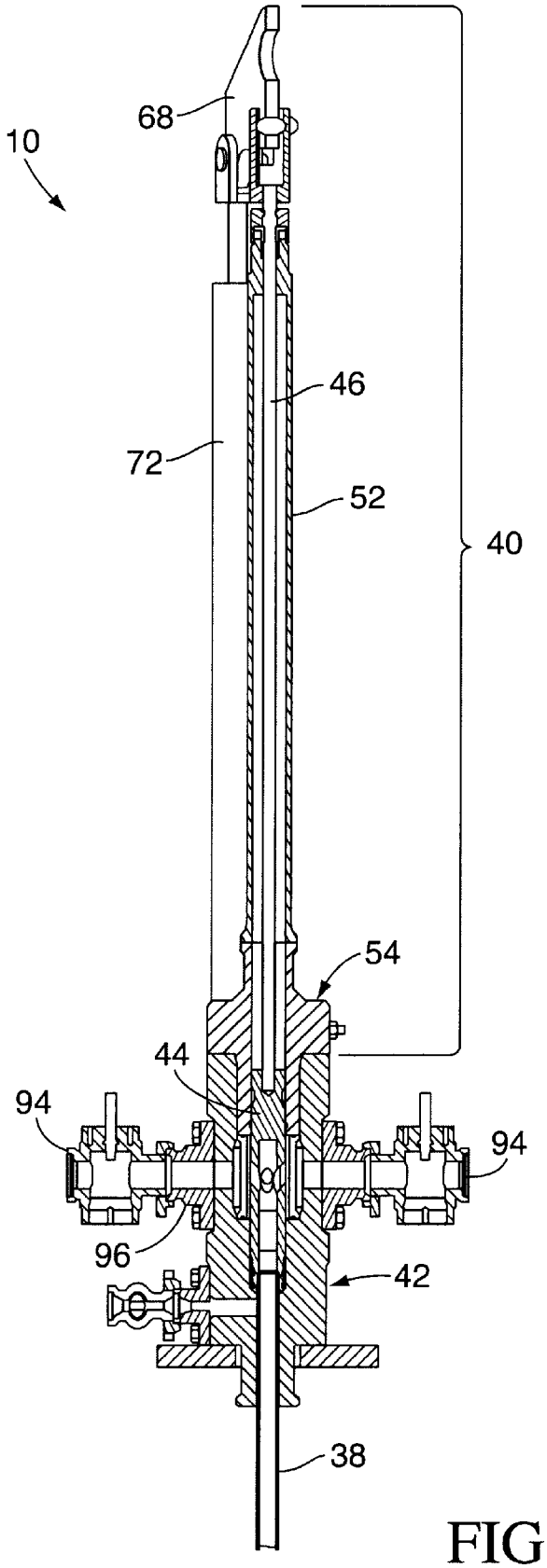
FIG. 1 is a longitudinal cross-sectional view of the WIT of the present invention.
Figure 2:
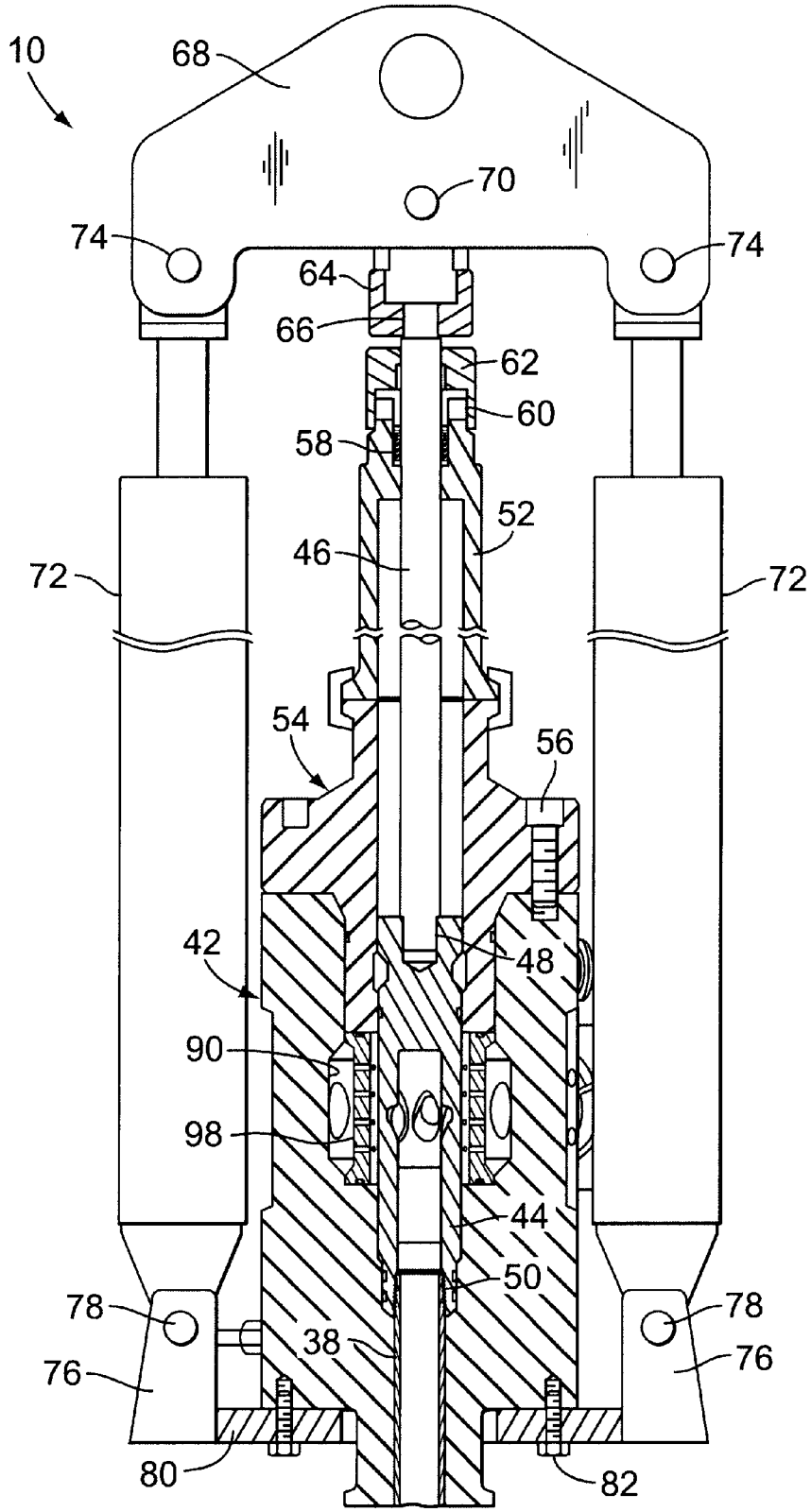
FIG. 2 is an enlarged longitudinal cross-sectional view of the WIT of the present invention, but with the cross section taken at a different radial angle than the cross section of FIG. 1.

Referring to FIGS. 1 and 2, the WIT 10 is shown to comprise a tubular mandrel 38, an actuator assembly 40, a pumping head 42 and a sleeve 44. The actuator assembly 40 is selectively operable to lower the mandrel 38 into the wellhead assembly 12 until the lower end of the mandrel engages the top of the production tubing string 20. The sleeve 44 serves to connect the mandrel 38 to the actuator assembly 40 and to communicate fluid from the pumping head 42 to the mandrel.

The actuator assembly 40 comprises a lift rod 46 that is threaded into the top of the sleeve 44 generally at 48. The mandrel 38 in turn is threaded into the bottom of the sleeve 44 generally at 50. The lift rod 48 extends through an elongated guide tube 52 which is attached to the top of the pumping head 42. In the embodiment of the invention illustrated in the Figures, the guide tube 52 is clamped to an adapter 54 which in turn is secured to the top of the pumping head 42, for example using bolts 56. The upper end of the lift rod 46 protrudes through an axial hole that extends through the top of the guide tube 52. A stem packing 58 is preferably provided to seal between the lift rod 46 and the guide tube 52. The stem packing 58 ideally is of the type shown in U.S. Pat. Nos. 4,527,806 or 4,576,385, both of which are hereby incorporated herein by reference, although any suitable type of stem packing could be used. The stem packing 58 is secured in place by a packing nut 60 which in turn is secured in position by a retainer cap 62 that is threaded to the top of the guide tube 52.

The top of the lift rod 46 is connected to a pivot connector 64 such as by threads 66. The pivot connector 64 is connected to a pivot arm 68 via a pin 70. Each end of the pivot arm 64 is connected to the upper end of a corresponding hydraulic cylinder 72 with suitable means, such as a pin 74. The lower end of each cylinder 72 is connected to a corresponding riser 76 such as by a pin 78, and each risers 76 is rigidly attached to a plate 80 that is secured to the bottom of pumping head 42, for example using bolts 82.

Referring again to FIG. 3, when the WIT 10 is used to stimulate the well, the mandrel 38 is lowered downward through the gates 30, 32 of the valve assemblies 22, 26, through the tubing hanger 18 and into the top of the production tubing string 20. An annular cup seal 84 is provided at the end of the mandrel 38 to seal between the outer diameter of the mandrel and the inner diameter of the tubing string 20. The seal 84 functions to isolate the fluid flow within the mandrel 38 and the tubing string 20, which is represented by the arrow 86, from an annulus 88 that surrounds the mandrel above the seal. The seal 84 is energized into sealing engagement with the tubing string 20 when the pressure below the seal is greater than the pressure in the annulus 88. While the cup seal 84 provides certain operational advantages in the present invention, it should be understood that any other suitable seal could be substituted for the cup seal.

Figure 4:
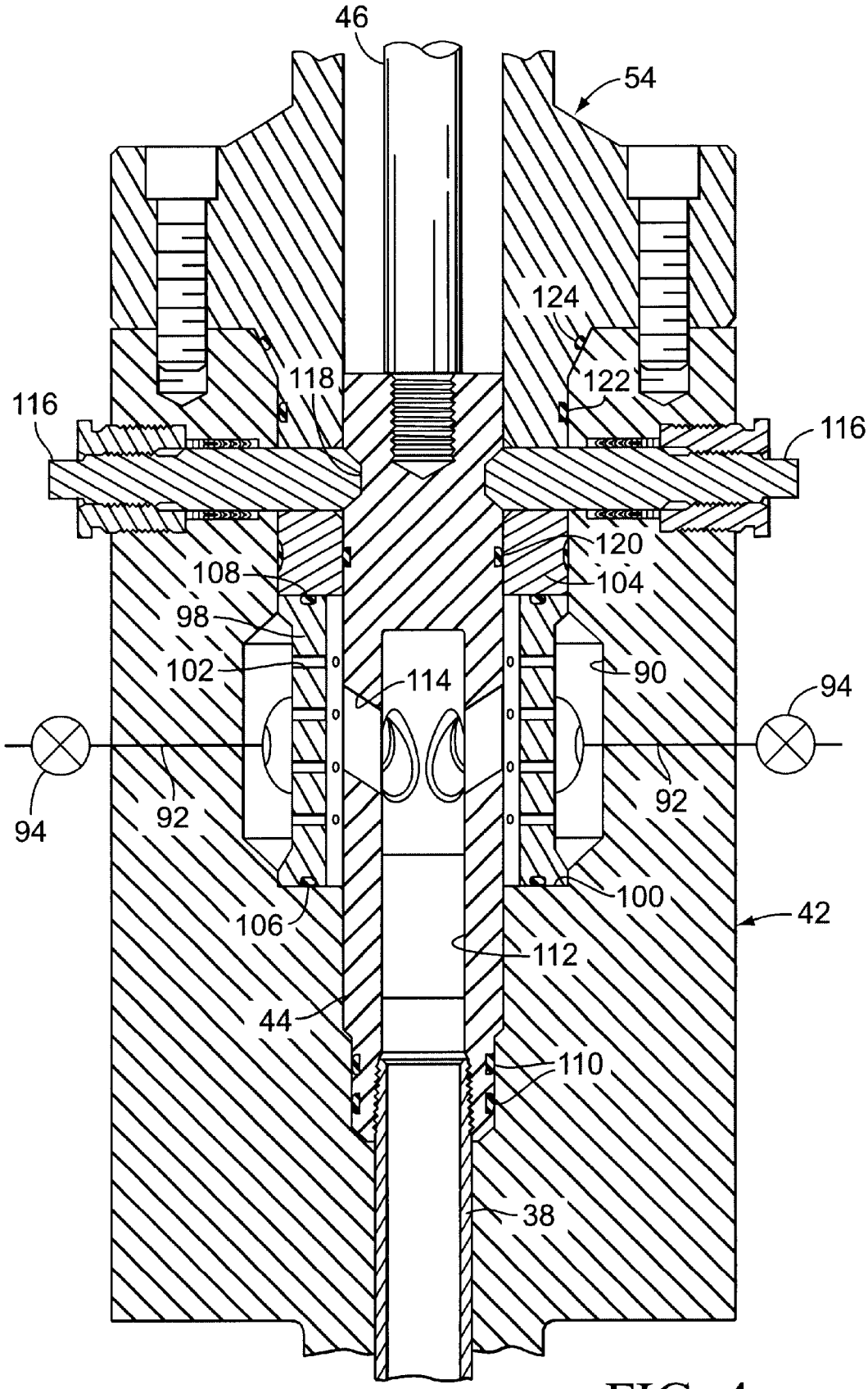
FIG. 4 is an enlarged cross-sectional view of the pumping head portion of the WIT depicted in FIG. 3.
Figure 5:
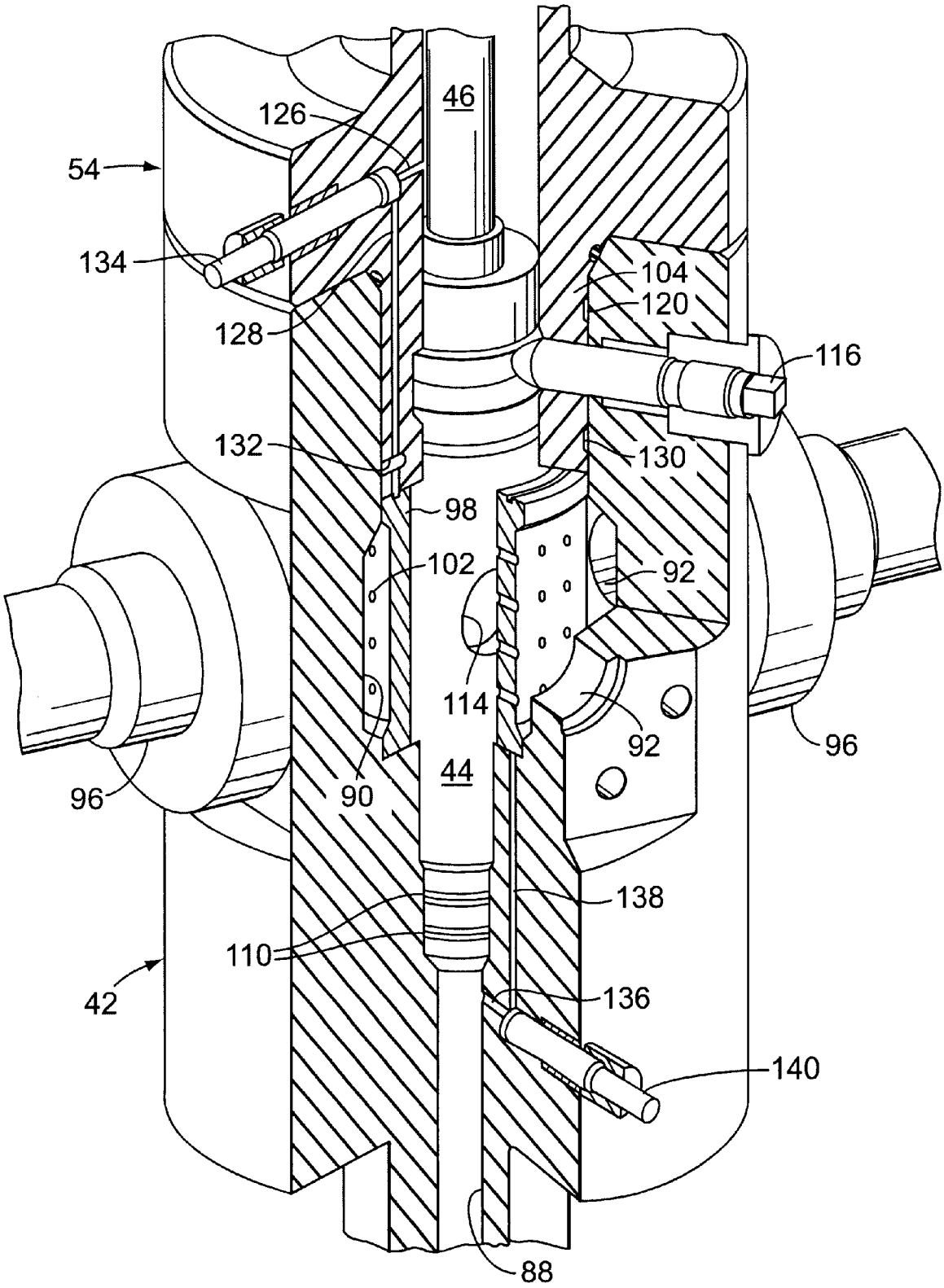
FIG. 5 is an isometric view of the pumping head portion of the WIT, with some components shown in partial section.

Referring to FIGS. 4 and 5, the pumping head 42 is shown to comprise an internal diffusion chamber 90, a number of fluid injection ports 92 which extend radially through the pumping head from the diffusion chamber to the outer diameter of the pumping head, and a corresponding number of valves 94 for controlling the flow of fluid through the injection ports. In a preferred embodiment of the invention, the interior surfaces of the diffusion chamber 90 and the injection ports 92 are coated or clad with a highly wear resistant material to minimize erosion. In addition, the valves 94 are ideally separate components which are bolted or otherwise secured to the outer diameter of the pumping head 42 via suitable connector members 96.

The pumping head 42 also comprises a generally cylindrical diffusion element 98 which is supported on a shoulder 100 that is formed in the bottom of the diffusion chamber 90. The diffusion element 98 optimally comprises an inner diameter which is slightly larger that the outer diameter of the sleeve 44, an outer diameter which is smaller than the inner diameter of the diffusion chamber 90, and a plurality of relatively small holes 102 which extend generally radially through the diffusion element between its inner diameter and its outer diameter. The diffusion element 98 is preferably made of a highly wear resistant material, such as tungsten carbide or silicon carbide. In addition, the diffusion element 98 is ideally held in position within the diffusion chamber 90 between the shoulder 100 and an axial extension 104 which depends from the bottom of the adapter 54.

The diffusion element 98 is preferably sealed to the diffusion chamber 90 to ensure that the fluid from the injection ports 92 passes through the holes 102. Accordingly, a first annular seal 106 is positioned between the bottom end of the diffusion element 98 and the shoulder 100, and a second annular seal 108 is positioned between the top end of the diffusion element and the axial extension 104. In addition, if the diffusion element 98 is made of a wear resistant material which is brittle in nature, it may be desirable to design the diffusion element such that its axial dimension is slightly smaller than the axial distance between the shoulder 100 and the axial extension 104 so that excessive clamping forces are not exerted on the diffusion element when the adapter 54 is fully connected to the pumping head 42. Accordingly, the first and second seals 106, 108 are adapted to seal across any resulting axial clearances between the bottom of the diffusion element 98 and the shoulder 100 and between the top of the diffusion element and the axial extension 104 to prevent the diffusion element from vibrating or "rattling" within the diffusion chamber 90. Seals 106, 108 are preferably elastomer O-rings, although any suitable seal could be used.

Referring still to FIGS. 4 and 5, when the mandrel 38 is lowered into the wellhead assembly 12, the sleeve 44 will land in the pumping head 42 and a number of annular seals 110 which are supported on the sleeve will seal against the pumping head to thereby isolate the diffusion chamber 90 from the annulus 88 that surrounds the mandrel above the seal 84. The sleeve 44 includes a blind bore 112 and a plurality of apertures 114 that extend radially downwardly from the outer diameter of the sleeve to the blind bore. The exposed surfaces of the sleeve 44 are preferably coated or clad with a highly wear resistant material to minimize erosion. When the sleeve 44 is seated in the pumping head 42, the apertures 114 are in general axial alignment with the diffusion chamber 90. The sleeve 44 is locked in this seated position by a number of lockdown screws 116, which are screwed inwardly until they engage an external groove 118 that is formed on the outer diameter of the sleeve.

In order to isolate the diffusion chamber 90 from the environment, a seal 120 is ideally provided between the outer diameter of the sleeve 44 and the central bore of adapter 54, and one or more seals 122,124 are optimally positioned between the outer diameter of the axial extension 104 and the central bore of pumping head 42. The seals 110,120 and 122 are preferably of the type disclosed in U.S. Pat. Nos. 5,791,657 or 5,180,008, both of which are hereby incorporated herein by reference, although any suitable seal could be used.

Referring specifically to FIG. 5, the adapter 54 preferably comprises a first passageway 126 which extends radially outward from the central bore of the adapter, a second passageway 128 which extends generally downwardly through the adapter from adjacent the first passageway, a radial groove 130 which is formed in the outer diameter surface of the axial extension 104 below the seal 120, and a third passageway 132 which extends between the radial groove and the bottom of the second passageway. Thus, the central bore of the adapter 54 is connected with the diffusion chamber 90 through the first, second and third passageways 126,128,132 and the radial groove 130. Furthermore, the first and second passageways 126,128 are connected through a conventional needle valve 134 which is mounted in the body of the adapter 54. Therefore, when the needle valve 134 is opened, the first and second passageways 126, 128 are connected and pressure can be equalized between the diffusion chamber 90 and the central bore of the adapter 54.

Similarly, the pumping head 42 comprises a first passageway 136 which extends radially outwardly from the central bore of the pumping head below the seals 110, a second passageway 138 which extends upwardly from the first passageway 136 to the shoulder 100, and a needle valve 140 which is disposed between the first and second passageways. Thus, the diffusion chamber 90 is connected with the annulus 88 around the mandrel 38 by the first and second passageways 136,138. Therefore, when the needle valve 140 is opened, the first and second passageways 136,138 are connected and pressure can be equalized between the diffusion chamber 90 and the annulus 88. Consequently, when the mandrel 38 is raised and lowered, the needle valves 134,140 can be used to overcome hydraulic lock conditions which could impede the movement of sleeve 44.

Referring again to FIG. 3, the pumping head 42 ideally also comprises a passage 142 which extends radially from the central bore of the pumping head below the seals 110 to the outer diameter of the pumping head. Flow through passage 142 is controlled by a valve 144, which is preferably a separate component that is bolted to the outer diameter of the pumping head 42. When the mandrel 38 is raised or lowered, fluid is injected through valve 144 and the passage 142 to pressurize the annulus 88 around the mandrel 38. This pressure collapses the cup seal 84 so that the seal does not drag against the tubing string 20 or the bore of the wellhead 14 as the mandrel 38 moves up or down.

In operation, when the WIT 10 is installed on the wellhead assembly 12, the hydraulic cylinders 72 are actuated to draw the lift rod 46, and thus the sleeve 44 and the mandrel 38, upward. Once the WIT 10 has been secured to the wellhead assembly 12, the valves 22, 26 are opened and the cylinders 72 are actuated to move the mandrel 38 downward. The mandrel 38 passes through the gates 30, 32, the wellhead 14 and the tubing hanger 18 until the bottom end of the mandrel enters and seals to the production tubing string 20. At this point, the sleeve 44 is landed and sealed in the pumping head 42, and the lockdown screws 116 are engaged to secure the sleeve, and thus the mandrel 38, in place.

Stimulation fluid is now pumped through the inlet valves 94 and the injection ports 92 and into the diffusion chamber 90. From the diffusion chamber 90, the fluid is forced through the small holes 102 in the diffusion element 98, through the angled apertures 114 in the sleeve 44 and down into the mandrel 38. The stimulation fluid is typically a highly erosive slurry and may also contain corrosive chemicals. However, the diffusion element 98 disperses the flow of the incoming fluid and thus prevents the fluid from impinging on isolated spots within the sleeve 44. The diffusion element 98 is intended to be a replaceable, sacrificial barrier for protecting the more expensive sleeve 44 from erosion. Moreover, the number and size of the holes 102 in the diffusion element 116 may be optimized for various fluids and flow velocities in order to minimize erosion of the diffusion element 98.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A wellhead isolation tool for use with a wellhead assembly from which a tubing string is suspended, the wellhead isolation tool comprising:

a tubular mandrel which includes an axial passage that extends therethrough and lower end that is adapted to engage the tubing string;

a pumping head which is connected over the wellhead assembly and which includes an internal chamber that is in fluid communication with the axial passage and a port that extends through the pumping head to the chamber; and actuator means connected over the pumping head for moving the mandrel axially through the pumping head and into engagement with the tubing string;

wherein when the mandrel is engaged with the tubing string, fluid may be communicated through the port, the chamber and the mandrel and into the tubing string.

2. The wellhead isolation tool of claim 1, further comprising:

a sleeve which is connected between the actuator means and the mandrel and which is positioned at least partially within the chamber when the mandrel is engaged with the tubing string;

the sleeve comprising an axial bore that communicates with the axial passage in the mandrel and at least one generally radial bore that communicates between the chamber and the axial bore.

3. The wellhead isolation tool of claim 2, further comprising:

a generally cylindrical diffusion element which is positioned within the chamber;

the diffusion element including an outer diameter surface, an inner diameter surface which surrounds at least a portion of the sleeve when the mandrel is engaged with the tubing string, and a plurality of holes which extend generally radially between the inner and outer diameter surfaces.

4. The wellhead isolation tool of claim 2, further comprising:

at least one first seal which is positioned between the sleeve and a central bore that extends axially through the pumping head below the chamber; and first means for selectively communicating pressure between the chamber and a portion of the central bore which is located below the seal.

5. The wellhead isolation tool of claim 4, wherein the first means comprises at least two fluid passageways which are connected together by a needle valve.

6. The wellhead isolation tool of claim 2, further comprising:

an adapter which is connected over the pumping head and which includes an inner diameter that surrounds at least a portion of the sleeve when the mandrel is engaged with the tubing string;

at least one second seal which is positioned between the sleeve and the inner diameter of the adapter above the chamber; and second means for selectively communicating pressure between the chamber and a portion of the inner diameter of the adapter which is located above the seal.

7. The wellhead isolation tool of claim 6, wherein the second means comprises at least two fluid passageways which are connected together by a needle valve.

8. The wellhead isolation tool of claim 1, wherein the actuator means comprises:

a guide tube which is connected to the pumping head;

a lift rod which is supported for axial movement within the guide tube and which comprises a lower end that is connected to the mandrel and an upper end that is connected to a pivot arm; and at least one hydraulic cylinder which is connected between the pivot arm and the pumping head.

9. The wellhead isolation tool of claim 1, further comprising means for sealing between the lower end of the mandrel and the tubing string.

10. The wellhead isolation tool of claim 9, wherein the sealing means comprises a cup seal which is energized by pressure in the tubing string.

11. The wellhead isolation tool of claim 10, further comprising means for selectively de-energizing the cup seal.

12. The wellhead isolation tool of claim 11, wherein the de-energizing means comprises a source of pressure which is selectively communicated to an area above the seal through a generally radial passage that extends through the pumping head, the central bore of the pumping head and an annulus which surrounds the mandrel.

13. The wellhead isolation tool of claim 2, further comprising means for securing the sleeve within the pumping head once the mandrel is engaged with the tubing string.

14. The wellhead isolation tool of claim 13, wherein the securing means comprises at least one lockdown screw which is mounted in the pumping head.

15. A wellhead isolation tool for use with a wellhead assembly from which a tubing string is suspended, the wellhead isolation tool comprising:

a pumping head which is connected over the wellhead assembly and which includes an outer surface, a central bore that extends generally axially through the pumping head, an internal chamber that is connected to the central bore, and at least one port that extends between the outer surface and the chamber;

a tubular mandrel which includes an upper end, a lower end that is adapted to engage the tubing string, and an axial passage that extends between the upper and lower ends;

a sleeve which is connected to the upper end of the mandrel and which is positioned at least partially within the chamber when the mandrel is engaged with the tubing string;

the sleeve comprising an axial bore that communicates with the axial passage in the mandrel and at least one generally radial bore that communicates between the axial bore and the chamber; and an actuator which is connected between the pumping head and the sleeve and which is selectively operable to move the mandrel axially into engagement with the tubing string;

wherein when the mandrel is engaged with the tubing string, fluid may be communicated through the port, the chamber, the sleeve and the mandrel and into the tubing string.

16. The wellhead isolation tool of claim 15, further comprising:

a generally cylindrical diffusion element which is positioned within the chamber;

the diffusion element including an outer diameter surface, an inner diameter surface which surrounds at least a portion of the sleeve when the mandrel is engaged with the tubing string, and a plurality of holes which extend generally radially between the inner and outer diameter surfaces.

17. The wellhead isolation tool of claim 16, wherein the actuator comprises:

a guide tube which is connected to the pumping head;

a lift rod which is supported for axial movement within the guide tube and which comprises a lower end that is connected to the sleeve and an upper end that is connected to a pivot arm; and at least one hydraulic cylinder which is connected between the pivot arm and the pumping head.

* * * * *